US008197353B2

(12) United States Patent
Brassard

(10) Patent No.: US 8,197,353 B2
(45) Date of Patent: Jun. 12, 2012

(54) TWISTED WATERSLIDE FLUME

(75) Inventor: Daniel Pierre Brassard, Vancouver (CA)

(73) Assignee: Whitewater West Industries, Ltd., Richmond (CA)

( * ) Notice: Subject to any disclaimer, the term of this patent is extended or adjusted under 35 U.S.C. 154(b) by 107 days.

(21) Appl. No.: 12/503,688

(22) Filed: Jul. 15, 2009

(65) Prior Publication Data

US 2010/0016090 A1 Jan. 21, 2010

Related U.S. Application Data

(60) Provisional application No. 61/081,015, filed on Jul. 15, 2008.

(51) Int. Cl.
*A63G 21/18* (2006.01)
*A63G 21/00* (2006.01)

(52) U.S. Cl. ..... 472/117; 104/69

(58) Field of Classification Search ..... 472/13, 472/116–117, 128–129; 104/69, 70
See application file for complete search history.

(56) References Cited

U.S. PATENT DOCUMENTS

| | | | | |
|---|---|---|---|---|
| 4,487,411 | A * | 12/1984 | Ahrens | 472/116 |
| 4,910,814 | A * | 3/1990 | Weiner | 4/488 |
| 5,433,671 | A * | 7/1995 | Davis | 472/117 |
| 6,527,646 | B1 * | 3/2003 | Briggs | 472/117 |
| 7,854,662 | B2 * | 12/2010 | Braun et al. | 472/117 |
| 2005/0282643 | A1 | 12/2005 | Hlynka | |

* cited by examiner

*Primary Examiner* — Kien Nguyen
(74) *Attorney, Agent, or Firm* — Greenberg Traurig LLP; J. Rick Tache

(57) ABSTRACT

The present disclosure provides a waterslide comprising at least one twisted flume segment, wherein the twisted flume segment defines a first open end and a second opposing open end rotated and translated with respect to the first open end. The present disclosure further provides a twisted waterslide flume segment and method for assembling the twisted waterslide flume segment. The twisted waterslide flume segment includes a plurality of adjacently disposed twisted flume sections, the twisted flume sections defining a first open end and a second opposing open end rotated and translated with respect to the first open end.

31 Claims, 6 Drawing Sheets

TWISTED WATERSLIDE FLUME

CROSS-REFERENCE TO RELATED APPLICATION

This application claims the benefit of U.S. Provisional Patent Application No. 61/081,015, filed on Jul. 15, 2008, the disclosure of which is hereby expressly incorporated herein by reference.

BACKGROUND

Waterslides are popular ride attractions for water parks, theme parks, family entertainment centers and destination resorts. The popularity of waterslide rides has increased dramatically over the years, and park patrons continue to seek out more exciting and stimulating ride experiences. Thus, there is an ever present demand for different and more exciting waterslide designs that offer riders a unique ride experience and that give park owners the ability to draw larger crowds to their parks.

Waterslides generally include an inclined water conveying course having an entry at an upper end and an exit pool or other safe landing structure at a lower end with a flow of water between the entry and the exit. A waterslide user slides down the course under the influence of gravity, with or without a conveyance device such as a flexible plastic mat, tube or raft. The water provides cooling fun for the ride participants, and also acts as a lubricant so as to increase the speed of the rider down the flume. Generally, the slide course is arranged along a sinuous or serpentine path with a series of bends, twists and turns which enhance the amusement value of the waterslide.

Typically a waterslide is formed from a plurality of straight and curved ("macaroni-shaped") flume segments, connected together in an end to end relationship to define the inclined waterslide course. The flume segments can be closed tubes or open, concave channels. The waterslide can comprise a mixture of different types of flume segments, for example, FIG. 1 of U.S. Patent Application Publication No. 2005/0282643 shows a waterslide comprising closed tube and open channel flume segments. Often waterslide flume segments are fabricated from plastic or fiberglass resin composites and furnished with flanges via which they are bolted or otherwise fastened together. Waterslide flume segments can be made up of several shorter flume sections that are similarly fastened together. Most commonly the flume segments and individual flume sections each consist of a constant cross-section that is typically circular or somewhat semi-circular in shape and define either a straight or curved two- or three-dimensional flume segment.

In some designs, circular-profiled tube sections, extruded along a simple circular curve, feature a flange at each end. These flanges can be fastened together, to form a segment of the waterslide or the entire length of the waterslide, such that the rotation axes of the extrusions are at an angle to each other, and thereby approximate helical paths. In other known waterslide designs the flume profile is generally non-circular in cross-section, and the flume is extruded along a helical path, the helical path having a center axis nearly (for example, within about 15 degrees) parallel to the planes of the flume cross-sections.

The present disclosure provides an improved design for a flume having a helical path to provide enhanced enjoyment to waterslide riders.

SUMMARY

The present disclosure provides a waterslide comprising at least one twisted flume segment, wherein the twisted flume segment defines a first open end and a second opposing open end rotated and translated with respect to the first open end.

The present disclosure further provides a twisted waterslide flume segment and method for assembling the twisted waterslide flume segment. The twisted waterslide flume segment includes a plurality of adjacently disposed twisted flume sections, the twisted flume sections defining a first open end and a second opposing open end rotated and translated with respect to the first open end.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
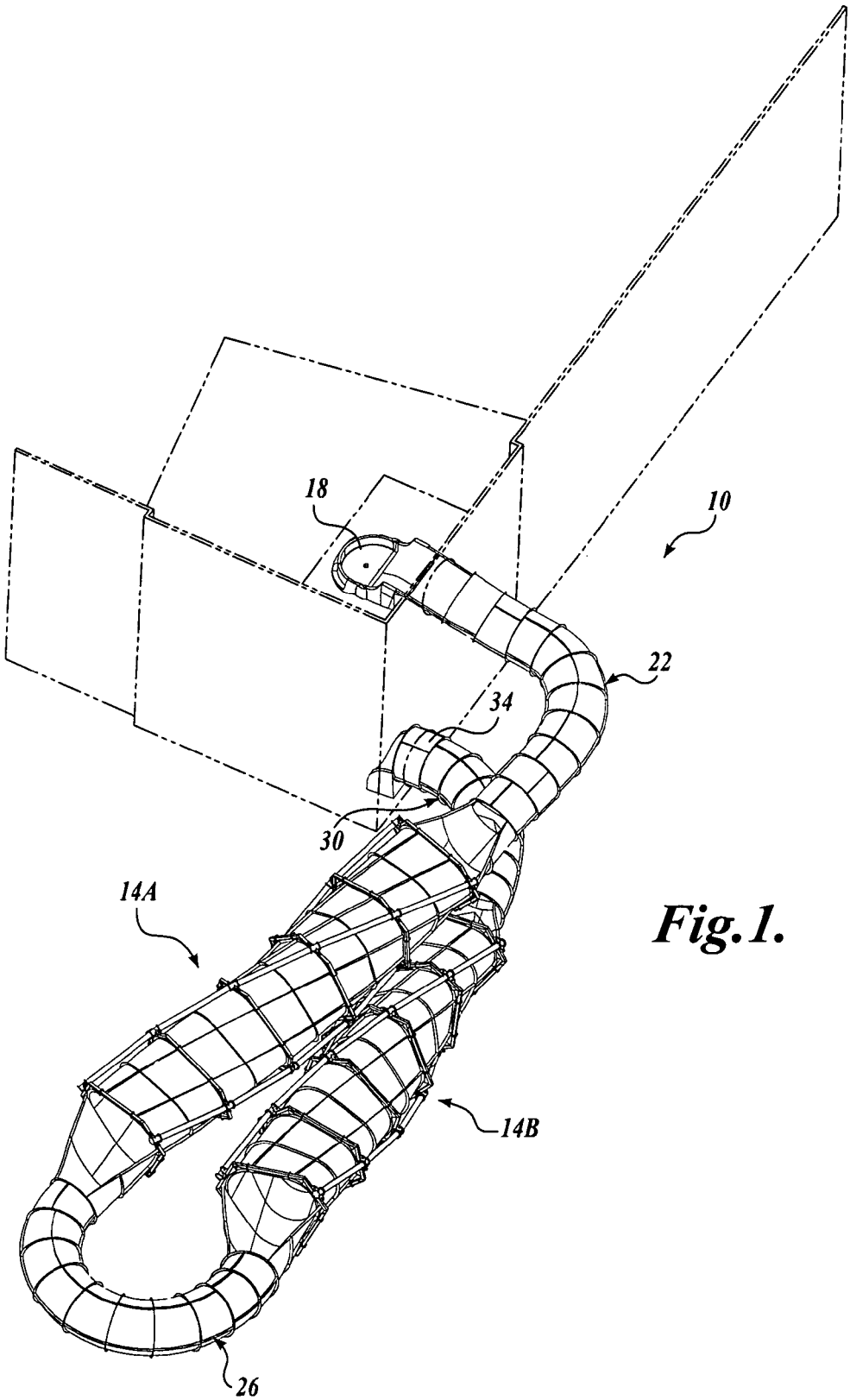
FIG. 1 is an isometric view of an exemplary waterslide having first and second twisted flume segments formed in accordance with one embodiment of the present disclosure.

A waterslide 10 having twisted flume segments 14A and 14B formed in accordance with one embodiment of the present disclosure can best be seen by referring to FIG. 1. Although the waterslide 10 may include any suitable arrangement and combination of flume segments, the waterslide 10 includes an entry 18 defined at the top, uphill portion of the waterslide 10, a curved flume segment 22 extending from the entry 18, a first twisted flume segment 14A extending from the curved flume segment 22, a second curved flume segment 26 extending between the first twisted flume segment 14A and a second twisted flume segment 14B, and a third curved flume segment 30 terminating in an exit 34 at the bottom, downhill portion of the waterslide 10. The construction of the twisted flume segments 14A and 14B will be described in further detail below; however, the construction and assembly of the remaining portions of the waterslide 10 may be done in any suitable manner now known in the art or later developed.

As shown in FIG. 1, the twisted flume segments 14A and 14B can each be formed as a substantially linear segment to form a straight portion of the waterslide 10. However, it should be appreciated, and it will become apparent from the description below, that the twisted flume segments 14A and 14B may instead be designed to bend or arc in a curve (about an external axis) to form one or more curved twisted flume segments in a waterslide. In either case the overall slide path of the twisted flume segments and the other portions of the waterslide may be generally downwardly inclined to move the rider from the entry 18 toward the exit 34 in an exhilarating yet safe manner. However, in certain embodiments, the twisted flume segments and/or other portions of the waterslide may be upwardly inclined. For instance, the waterslide may be undulating with an overall general downward incline from the entry point to the exit point. In other examples, the waterslide may include an entry point that is lower in elevation than the exit with any suitable upwardly or downwardly inclined segments extending therebetween. In such a case, riders would be conveyed along the upwardly inclined portions of the slide path by using, for example, water jets, conveyors, etc., in combination with the inertia of the rider gained on the downwardly inclined segments (if any).

The twisted flume segments 14A and 14B create a unique internal ride surface for the waterslide 10 while requiring relatively few parts for construction. It should be appreciated that although the twisted flume segments 14A and 14B will be hereinafter described as forming a certain portion of a waterslide, the twisted flume segments 14A and 14B may instead define substantially the entire waterslide path or may be used in combination with various types of flume segments or other waterslides features to form any suitable waterslide structure. Moreover, as noted above, the twisted flume segments may be substantially linear or straight in overall shape; however, the twisted flume segment may instead be constructed to define a bend or curve in the waterslide. Furthermore, in the waterslide illustrated in FIG. 1, the twisted flume segments 14A and 14B are shown as having a significantly larger diameter or cross-sectional area than the curved flume segments 22, 26, and 30, however this need not be the case. Thus, the following description shall not be seen as limiting the scope of the claimed subject matter.

Referring to FIGS. 2A-2C and 3A-3C, a preferred embodiment of a twisted flume segment 114 will be hereinafter described in detail. Although the twisted flume segments 114 are illustrated and described as being closed tube flume segments, it should be appreciated that the twisted flume segments 114 may instead be formed with an upwardly-oriented opening to define an open channel flume segment.

Figure 2B:
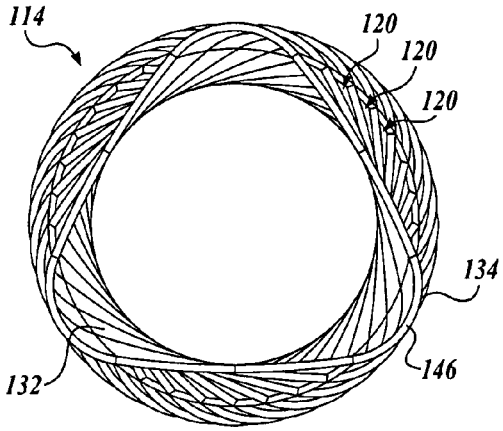
FIG. 2B is front plan view of the twisted flume segment of FIG. 2A.
Figure 2A:
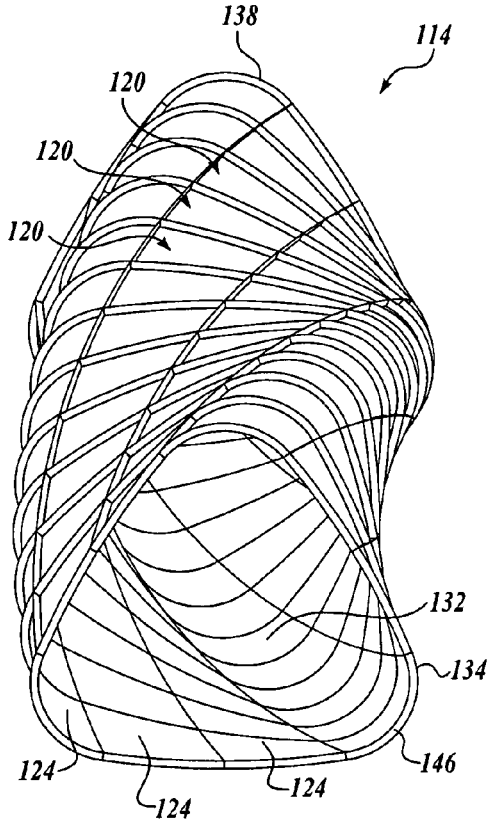
FIG. 2A is an isometric view of a twisted flume segment as substantially depicted in FIG. 1.
Figure 2C:
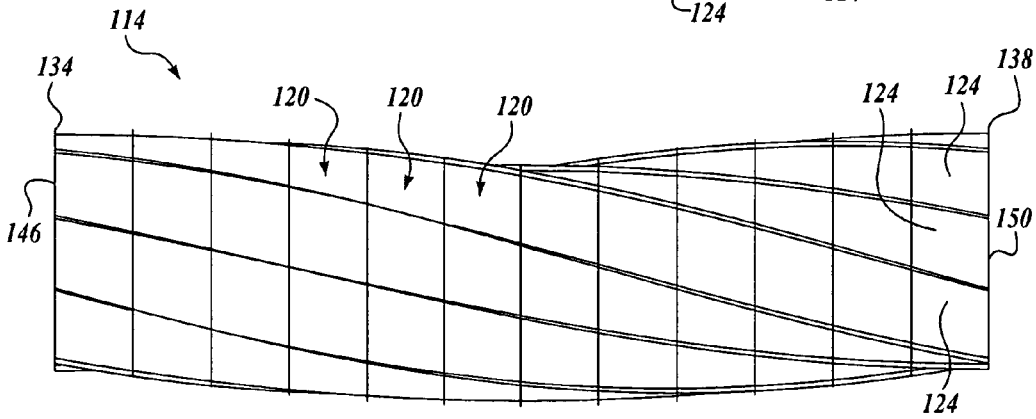
FIG. 2C is side plan view of the twisted flume segment of FIG. 2A.

Referring specifically to FIGS. 2A-2C, in the illustrated embodiment, the twisted flume segments 114 have a non-circular profile or cross-section and are swept along a helix having a center axis oriented substantially perpendicular to the planes of the cross-sections of the flume segment 114. For instance, the profile of the twisted flume segment 114 may be swept along a helical path with the center of the axis being generally within about fifteen degrees (15°) of perpendicular to the planes of the cross-sections of the flume segment 114. Thus, the twisted flume segment 114 itself has a helical axis (also known as a screw axis or twist axis) that is preferably located at or close to the centroid of the cross-section of the flume segment. To define the twist in the segments 114, the two opposing open ends of the non-circular twisted flume segments 114 are rotated and translated with respect to one another so that there is a twist in each segment 114. The profile or twist of the segment 114 can be rotated in either direction.

Figure 3A:
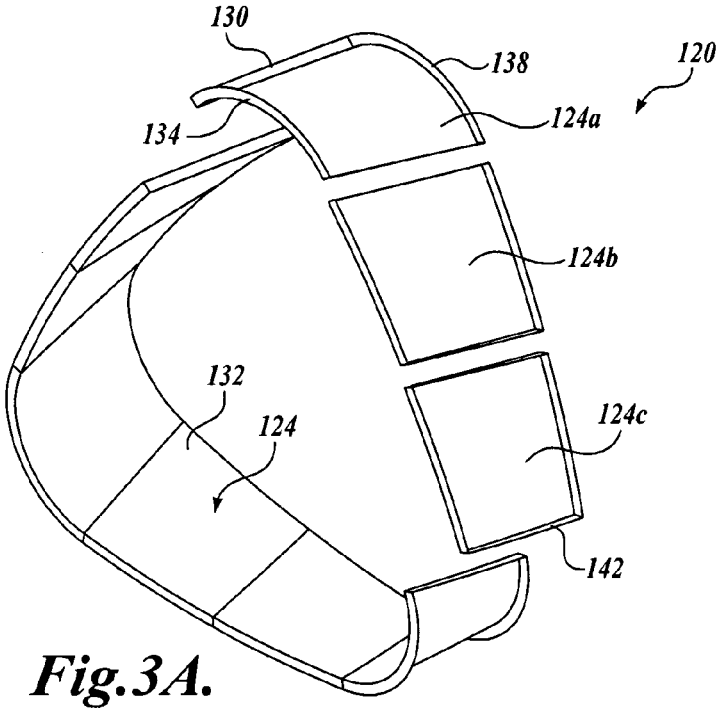
FIG. 3A is an isometric partially exploded view of a twisted flume section forming a part of the twisted flume segment of FIG. 2A.
Figure 3B:
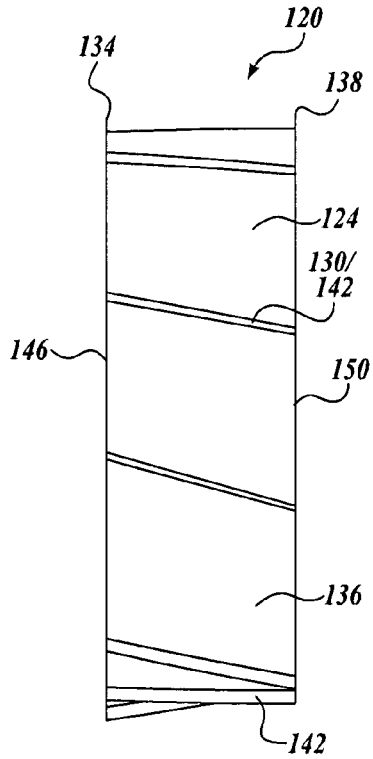
FIG. 3B is a side plan view of the twisted flume section of FIG. 3A.
Figure 3C:
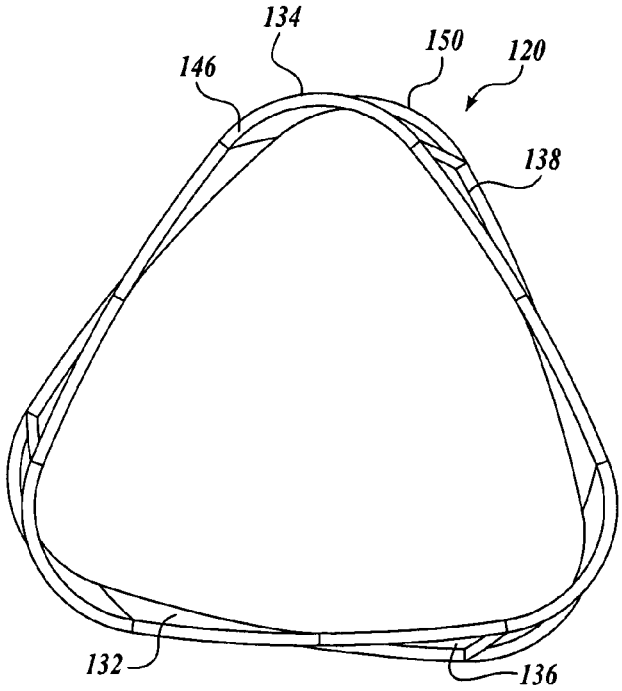
FIG. 3C is a front plan view of the twisted flume section of FIG. 3A.

The twisted flume segments 114 generally comprise two or more twisted flume sections 120 adjacently disposed or attached together. An isolated twisted flume section 120 is depicted in FIGS. 3A-3C. Although the twisted flume section 120 may be of any appropriate design and construction, the twisted flume section 120 can comprise nine fiberglass panels 124 as illustrated. Each panel 124 includes an interior, generally concave surface 132 and an exterior, generally convex surface 136. Each panel 124 further includes a front flange 134 extending transversely outwardly from a front edge of the panel 124, a rear flange 138 extending transversely outwardly from a rear edge of the panel 124, and intermediary flanges 130 and 142 extending transversely outwardly from first and second inner edges of the panel 124. The panels 124 are coupled together by attaching the intermediary flanges 130 and 142 together in any suitable, well-known manner, such as with adhesive or with fasteners. When attached together, the panels 124 define a smooth interior surface of the twisted flume section 120.

The panels 124 are of a shape and geometry designed such that when attached together they collectively define the twisted flume section 120 having an appropriate shape and geometry. As can be seen in FIG. 3C, the illustrated embodiment of the twisted flume section 120 is somewhat triangular in cross-sectional shape. More specifically, the assembled panels define a cross-sectional shape substantially similar to an equilateral triangle with a substantial fillet at the corners and a slight outward curved line extending between the filleted corners.

In the illustrated embodiment, the twisted flume section is composed of nine panels. For ease of manufacture and assembly, the twisted flume section 120 can be comprised of three different panel designs, 124*a*, 124*b*, and 124*c*, wherein three panels of each design are used to create the twisted flume segment 120. More specifically, a set of each of the panels 124*a*, 124*b*, and 124*c* are used to form a third of the "equilateral triangle" described above. It should be appreciated that the cross-sectional shape of the twisted flume section 120 may instead be another suitable general shape, such as a square, pentagon, hexagon, oval, ellipse, or another regular or irregular shape. Preferably the cross-sectional shape is non-circular, although in some embodiments the cross-sectional shape can be circular, for example with the helical axis being offset from the centroid of the circular cross-section. Regardless of cross-sectional shape, the twisted flume section 120 may be subdivided into two or more panels. Thus, it should be appreciated that the panel construction may be used to form a twisted flume section 120 of any suitable cross-sectional shape. Moreover, by using discrete panels to form the twisted flume section 120, an exciting ride path can be created from a small number of unique panel designs (or parts), permitting savings in tooling, fabrication and installation costs.

With the panels 124 attached together at the intermediary flanges 130 and 142 to define the triangular shape discussed above, the front flanges 134 of the panels 124 collectively define a front transverse attachment edge 146, and the rear flanges 138 of the panels 124 collectively define a rear transverse attachment edge 150. The front transverse attachment edge 146 is substantially identical in shape and size to the rear transverse attachment edge 150. Moreover, the front transverse attachment edge 146 is translated some parallel distance from the rear transverse attachment edge 150 along the length or longitudinal axis of twisted flume section 120 with the body of the twisted flume section 120 (defined by the interior and exterior panel surfaces 132 and 136) extending therebetween. The body of each section 120 also includes a twist such that the front transverse attachment edge 146 is rotated by some angle about the centroid of the cross-section of twisted flume section 120 relative to the rear transverse attachment edge 150. FIG. 3C shows how front transverse attachment edge 146 is rotated with respect to rear transverse attachment edge 150 of the twisted flume section 120. Thus, the body of the flume section 120 joining the front and rear transverse attachment edge 146 and 150 has a twist in it that is swept along the natural helix described by the foregoing translation and rotation.

It should be appreciated that the twisted flume sections 120 may instead be formed as one unitary piece rather than being comprised of a plurality of two or more discrete panels attached together. Regardless, for most waterslide applications the twisted the flume segments 120 are formed from a molded plastic or composite material. Fiberglass resin composites are particularly suitable.

Referring back to FIGS. 2A-2C, twisted flume sections 120 of substantially identical cross-sectional shape and geometry are attached together to define a preferred embodiment of a linear twisted flume segment 114, as depicted. More specifically, twisted flume sections 120 are attached together such that the rear transverse attachment edge 150 of a first twisted flume section is attached with the front transverse attachment edge 146 of a second twisted flume section 120 in a manner well known in the art. Similarly, the front transverse attachment edge 146 of a third twisted flume section 120 is attached with the rear transverse attachment edge 150 of the second twisted flume section 120. A number of twisted flume sections 120 are attached together in this manner until the twisted flume sections 120 collectively define a twisted flume segment 114 of a suitable length.

With the front and rear transverse attachment edges 146 and 150 being substantially congruent when attached together, and with the body of the flume section "twisting" between the edges 146 and 150 as described above, the twisted flume sections 120 form a twisted flume segment 114 having a cross-sectional shape that is not bilaterally symmetrical about the gravity vector, and the orientation of the cross-sectional profile changes markedly from the perspective of a rider. As shown in FIGS. 2A-2C, the profile of the twisted flume segment 14 rotates as the segment 14 is traversed and the interior surface of the twisted flume segment 114 provides an undulating ride surface for the waterslide user.

Moreover, when the adjacent twisted flume sections 120 have substantially the same cross-sectional shape, the twisted flume segment 114 formed by these twisted flume sections 120 will have substantially "infinite helical symmetry". An object has infinite helical symmetry if, for any small rotation of the object around its central axis, there exists a point nearby (the translation distance) on that axis at which the object will appear exactly as it did before.

In other embodiments, the cross-sectional shape of adjacent twisted flume sections can be varied. In such a case, the twisted flume segment of the waterslide formed by these non-identical linked twisted flume sections will have lesser helical symmetry. For example, the cross-sectional shape of the twisted flume sections may change from one end to the other, or the twisted flume segment may change in cross-sectional shape from one segment to another. In some cases, the twisted flume sections may be arranged in a varying pattern or may be repeated for a number of flume sections. Although such embodiments are within the scope of the present disclosure, it should be appreciated that such embodiments will generally require a greater number of unique sections for construction of the twisted flume segments.

The above-described method of constructing a twisted flume segment 114 creates a unique internal ride surface in waterslides, which permits a changing transverse slope under a rider traveling through the waterslide, while requiring relatively few unique sections in the construction.

Figure 4A:
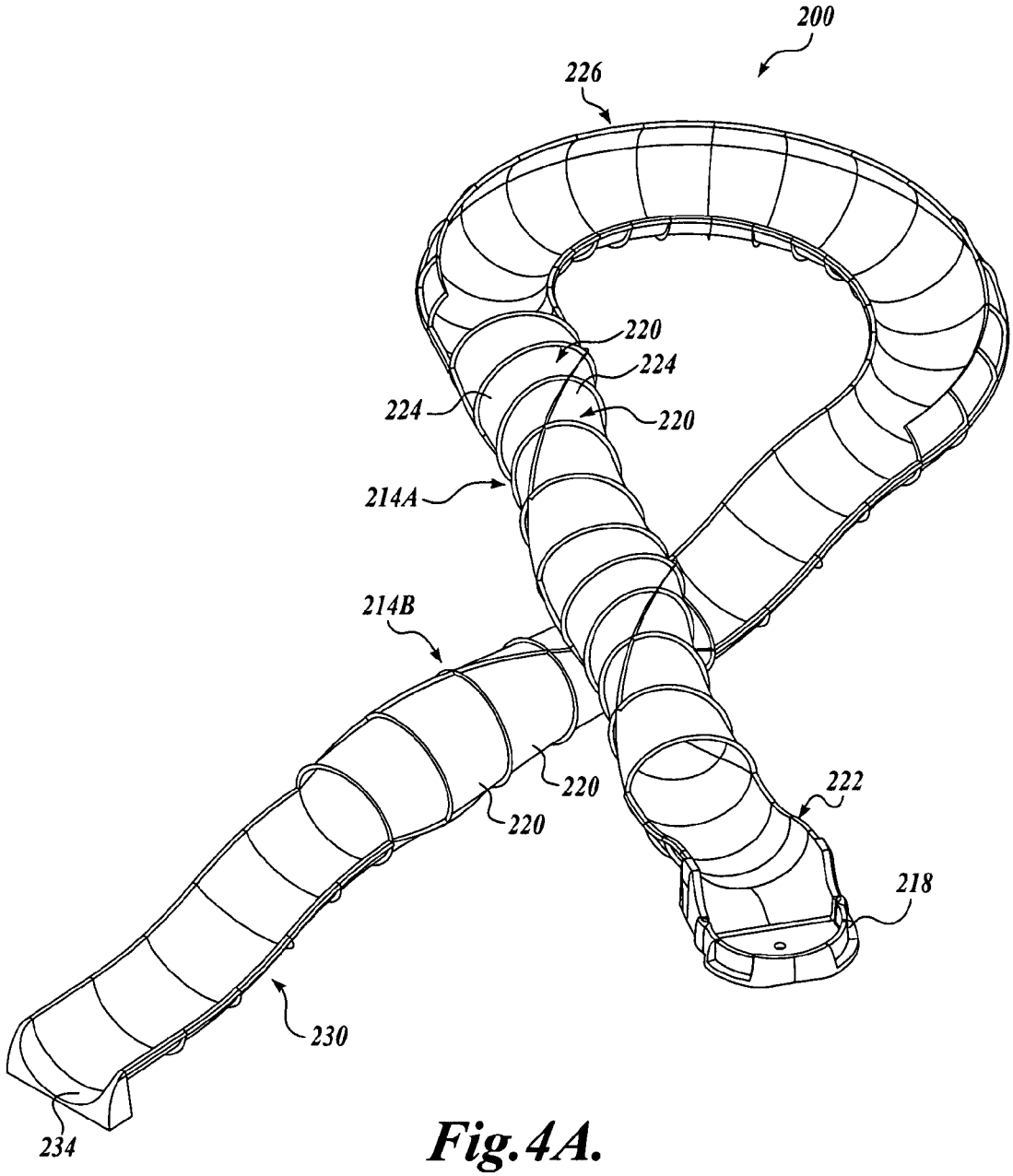
FIG. 4A is an isometric view of an exemplary embodiment of a waterslide incorporating several open-channel portions and first and second twisted flume segments, wherein the twisted flume segments are comprised of a plurality of twisted flume sections formed in accordance with another embodiment of the present disclosure.
Figure 4B:
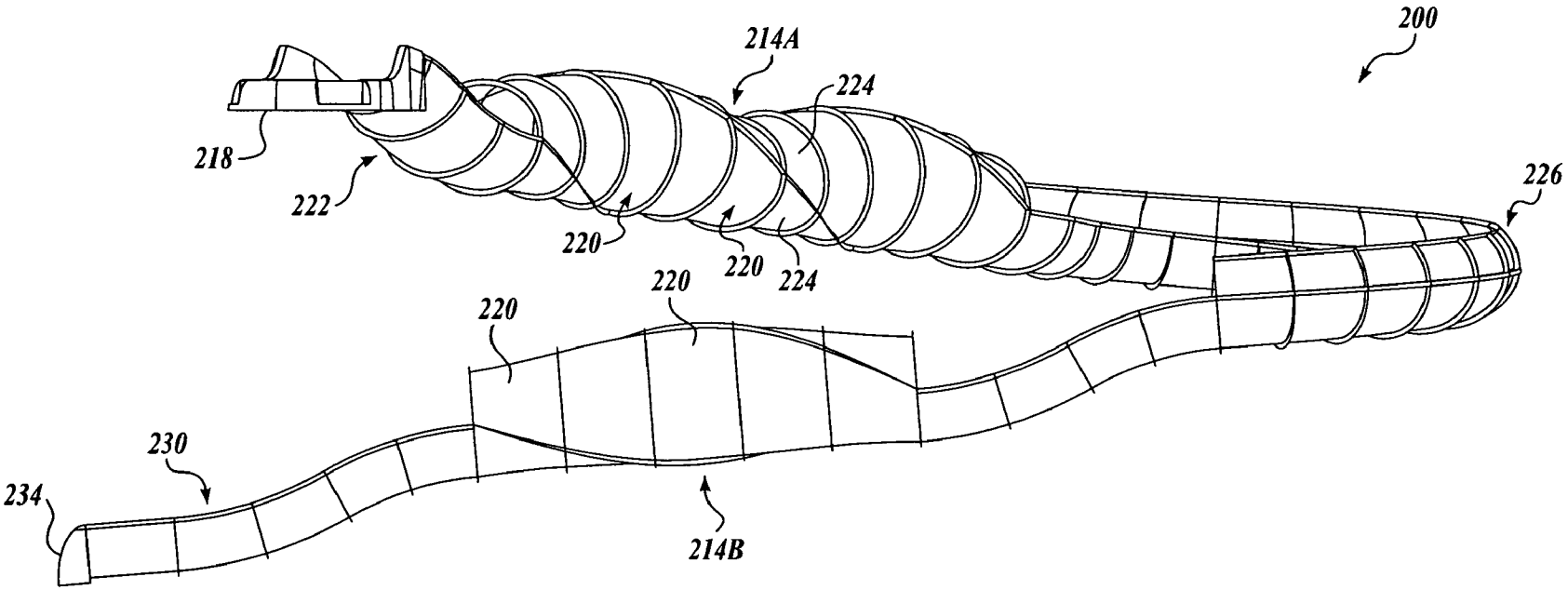
FIG. 4B is a side view of the waterslide of FIG. 4A.
Figure 4C:
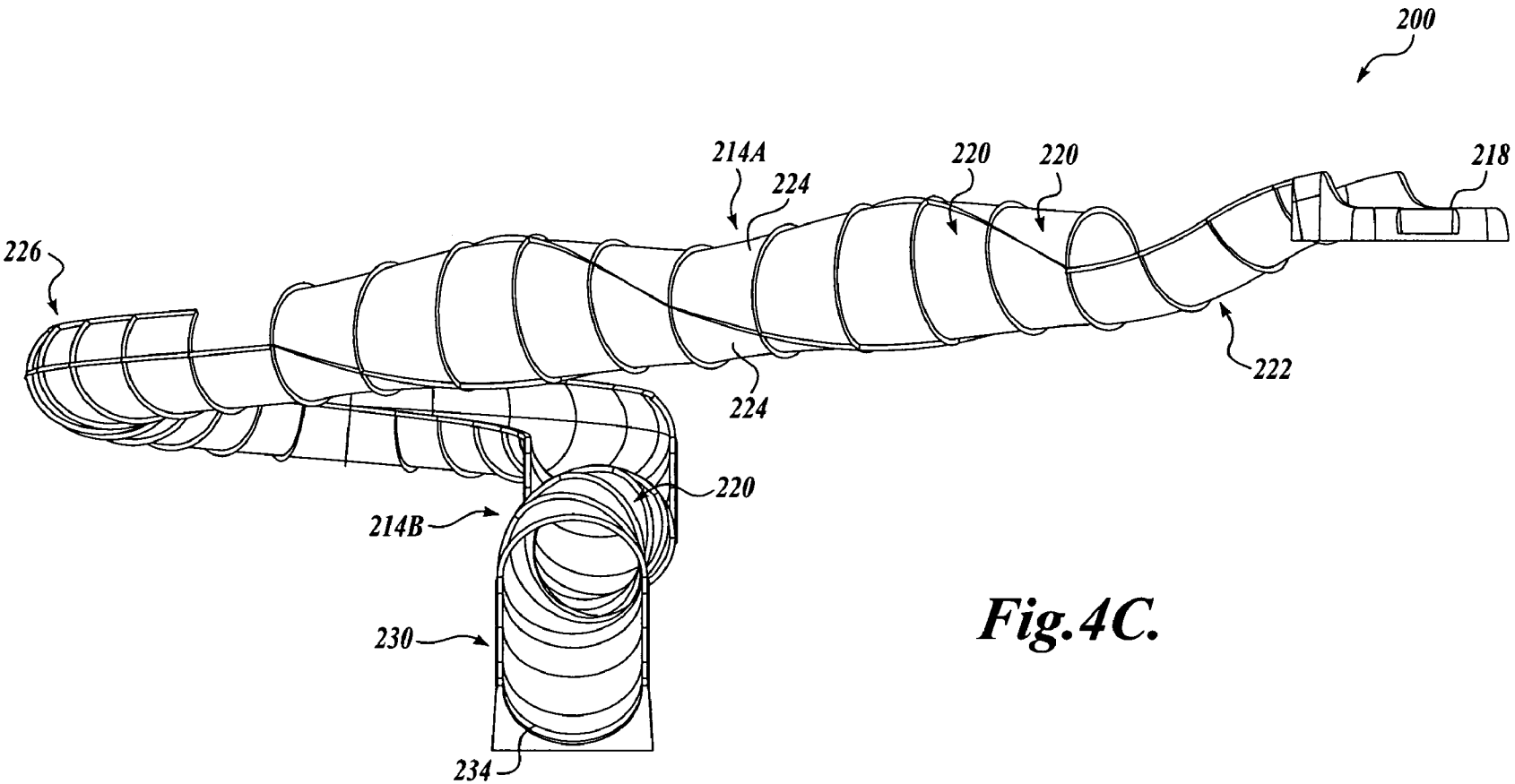
FIG. 4C is a front view of the waterslide of FIG. 4A.

Referring to FIGS. 4A-4C, a waterslide 200 having twisted flume segments 214A and 214B formed in accordance with another embodiment of the present disclosure is depicted. Although the waterslide may include any suitable arrangement and combination of flume segments, the waterslide 200 includes an entry 218 defined at the top, uphill portion of the waterslide 200, a curved flume segment 222 extending from the entry 218, a twisted flume segment 214A extending from the curved flume segment 222, a curved open flume segment 226 extending from the twisted flume segment 214A, a twisted flume segment 214B extending from the curved flume segment 226, and an open straight flume segment 230 extending from the twisted flume segment 214B and terminating in an exit 234 at the bottom, downhill portion of the waterslide 200. Thus, it can be seen from the waterslide embodiment depicted in FIGS. 4A-4C that one or more twisted flume segments may be used with different waterslide structures and combinations of flume segments.

Moreover, the twisted flume segments 214A and 214B depicted in FIGS. 4A-4C are constructed of individual twisted flume sections 220 attached together in substantially the same manner described above with respect to the twisted flume segments 114A and 114B. However, it can be seen that the cross-sectional shape of the twisted flume sections is generally elliptical rather than generally triangular, square, hexagonal, etc. (i.e. a shape defining corners) and that the twisted flume sections 220 are each constructed of two individual panels 224 coupled together. It can be appreciated that a twisted flume section having a generally elliptical shape may instead be formed from more than two discrete panels coupled together, or as a smooth, unitary piece rather than discrete panels.

It should further be noted that a computer-model simulation has been performed for a waterslide similar to the waterslide 200 illustrated in FIGS. 4A-4C. The simulation predicts that a family raft traveling downhill along the waterslide will move from side-to-side in response to the change in profile of the twisted flume segments 214A and 214B with respect to the linear position in the waterslide. As such, it can be understood that the profile of the twisted flume segments 214A and 214B will provide the rider with an exhilarating side-to-side motion or ride path as they move through the twisted flume segments 214A and 214B.

It should be understood that the waterslides and twisted flume segments described herein may be sufficiently large to accommodate a family raft or other multiple-rider conveyance device, or they may instead be sized so that they are suitable for a single rider with or without a conveyance device. It should also be appreciated that the twisted flume segments and waterslides described herein have an exterior appearance entirely distinct from that of previous waterslides or waterslide flume segments. To enhance this exterior appearance, lighting, visual effects, construction materials, and the support frame architecture surrounding the waterslide may be chosen and/or designed to enhance the exterior appearance and create a unique, interesting and appealing waterslide to riders.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A waterslide comprising at least one twisted flume segment having a cross-section, wherein the twisted flume segment defines a first open end and a second opposing open end rotated and translated with respect to the first open end, wherein the twisted flume segment has a helical axis, the helical axis oriented substantially perpendicular to the plane of the cross-section of the twisted flume segment and located approximately at the centroid of the cross-section of the twisted flume segment.

2. The waterslide of claim 1, wherein said twisted flume segment has a non-circular cross-section.

3. The waterslide of claim 1, wherein the at least one twisted flume segment is a tube.

4. The waterslide of claim 1, wherein the at least one twisted flume segment is defined by a plurality of adjacently disposed twisted flume sections.

5. The waterslide of claim 4, wherein the plurality of adjacently disposed twisted flume sections form a substantially straight twisted flume segment of the waterslide.

6. The waterslide of claim 4, wherein the plurality of adjacently disposed twisted flume sections form a curved twisted flume segment of the waterslide.

7. The waterslide of claim 4, wherein the twisted flume sections are substantially identical in size, shape, and geometry.

8. The waterslide of claim 7, wherein the twisted flume sections have a cross-sectional profile that is roughly triangular in shape.

9. The waterslide of claim 7, wherein the twisted flume sections have a cross-sectional profile that is roughly elliptical in shape.

10. The waterslide of claim 4, wherein the twisted flume sections each comprise a plurality of panels attached together.

11. The waterslide of claim 4, wherein the twisted flume sections are fabricated from a fiberglass resin composite material.

12. A twisted waterslide flume segment comprising a plurality of adjacently disposed twisted flume sections each having a cross-section, the twisted flume sections defining a first open end and a second opposing open end rotated and translated with respect to the first open end, wherein each twisted flume section defines a front attachment flange and a rear attachment flange and a body portion extending therebetween, the body portion having a twist such that the first attachment flange is rotated by some angle about an axis oriented substantially perpendicular to the plane of the cross-section of the twisted flume section and located approximately at the centroid of the cross-section of the twisted flume section.

13. The twisted waterslide flume segment of claim 12, wherein each of said twisted flume sections is non-circular in cross-section.

14. The twisted waterslide flume segment of claim 12, wherein the flume segment comprising the plurality of adjacently disposed twisted flume sections is substantially straight.

15. The twisted waterslide flume segment of claim 12, wherein the flume segment comprising the plurality of adjacently disposed twisted flume sections is curved.

16. The twisted waterslide flume segment of claim 12, wherein the twisted flume sections each comprise a set of panels attached together, wherein the set of panels comprises at least two panels.

17. The twisted waterslide flume segment of claim 16, wherein at least first and second sets of panels are attached together to form the twisted flume segment.

18. The twisted waterslide flume segment of claim 17, wherein the first set includes at least one panel that is substantially identical in size, shape, and geometry to at least one panel in the second set.

19. A method for assembling a twisted flume segment for use in a waterslide structure, the method comprising: (a) providing a plurality of twisted flume sections each having a cross-section, each twisted flume section having a first open end and a second opposing open end rotated and translated with respect to the first open end; (b) attaching at least the first open end of a first twisted flume section to the second opposing open end of a second twisted flume section, wherein each twisted flume section defines a front attachment flange and a rear attachment flange and a body portion extending therebetween, the body portion having a twist such that the first attachment flange is rotated by some angle about an axis oriented substantially perpendicular to the plane of the cross-section of the twisted flume section and located approximately at the centroid of the cross-section of the twisted flume section.

20. The method of claim 19, further comprising forming each of the twisted flume sections by attaching at least a first panel to a second panel.

21. The method of claim 19, further comprising forming each of the twisted flume sections with first and second sets of panels.

22. The method of claim 21, wherein the first set includes at least one panel that is substantially identical in size, shape, and geometry to at least one panel in the second set.

23. The method of claim 19, wherein the twisted flume sections are substantially identical in size, shape, and geometry.

24. A method for assembling a twisted flume segment for use in a waterslide structure, the method comprising: (a) providing a plurality of twisted flume sections each having a cross-section, each twisted flume section having a first open end and a second opposing open end rotated and translated with respect to the first open end; (b) attaching at least the first open end of a first twisted flume section to the second opposing open end of a second twisted flume section, wherein the twisted flume sections each have a helical axis, the helical axis oriented substantially perpendicular to the plane of the cross-section of the twisted flume section and located approximately at the centroid of the cross-section of the twisted flume sections.

25. The method of claim 24, further comprising forming each of the twisted flume sections by attaching at least a first panel to a second panel.

26. The method of claim 24, further comprising forming each of the twisted flume sections with first and second sets of panels.

27. The method of claim 26, wherein the first set includes at least one panel that is substantially identical in size, shape, and geometry to at least one panel in the second set.

28. The method of claim 24, wherein the twisted flume sections are substantially identical in size, shape, and geometry.

29. A twisted waterslide flume segment comprising a plurality of adjacently disposed twisted flume sections each having a cross-section, the twisted flume sections defining a first open end and a second opposing open end rotated and translated with respect to the first open end, wherein the twisted flume sections are substantially identical in size, shape, and geometry, and wherein the twisted flume sections each have a helical axis, the helical axis oriented substantially perpendicular to the plane of the cross-section of the twisted flume section and located approximately at the centroid of the cross-section of the twisted flume section.

30. The twisted waterslide flume segment of claim 29, wherein the twisted flume sections have a cross-sectional profile that is roughly triangular in shape.

31. The waterslide of claim 29, wherein the twisted flume sections have a cross-sectional profile that is roughly elliptical in shape.

* * * * *